US011186397B2

(12) United States Patent
Bergwerff et al.

(10) Patent No.: US 11,186,397 B2
(45) Date of Patent: Nov. 30, 2021

(54) METHOD AND APPARATUS FOR PACKAGING OF ONE OR MORE BOXES FILLED WITH TOBACCO IN A PLASTIC BAG

(71) Applicant: Oxy-Low Systems Europe BV, Numansdorp (NL)

(72) Inventors: Frederik Bergwerff, Klaaswaal (NL); Louis Jean Van Rennes, Klaaswaal (NL); Robert George McCarthy, Jawa Timur (ID)

( * ) Notice: Subject to any disclaimer, the term of this patent is extended or adjusted under 35 U.S.C. 154(b) by 103 days.

(21) Appl. No.: 15/574,498

(22) PCT Filed: May 11, 2016

(86) PCT No.: PCT/NL2016/050337
§ 371 (c)(1),
(2) Date: Nov. 16, 2017

(87) PCT Pub. No.: WO2016/186487
PCT Pub. Date: Nov. 24, 2016

(65) Prior Publication Data

US 2018/0127127 A1 May 10, 2018

(30) Foreign Application Priority Data

May 16, 2015 (NL) ..... 2014811

(51) Int. Cl.
*B65B 31/02* (2006.01)
*B65B 5/04* (2006.01)

(52) U.S. Cl.
CPC ..... *B65B 31/024* (2013.01); *B65B 5/045* (2013.01); *B65B 31/025* (2013.01); *B65B 2220/16* (2013.01)

(58) Field of Classification Search
CPC .... B65B 1/26; B65B 5/00; B65B 5/04; B65B 5/045; B65B 31/02; B65B 31/024;
(Continued)

(56) References Cited

U.S. PATENT DOCUMENTS 4,922,686 A * 5/1990 Segota ..... B65B 31/024 53/434
5,044,142 A * 9/1991 Gianelli ..... B65B 31/024 53/434

(Continued)

*Primary Examiner* — Hemant Desai
*Assistant Examiner* — Jacob A Smith
(74) *Attorney, Agent, or Firm* — Patshegen IP LLC; Moshe Pinchas

(57) ABSTRACT

A method for packaging one or more tobacco-filled boxes (13) in a plastic bag (21) comprises the following steps of—placing the box in a vacuum chamber (3, 5) through an input (7),—closing the vacuum chamber, then evacuating the vacuum chamber and thereafter creating an over-pressure nitrogen atmosphere in the vacuum chamber—putting a bag open at one end around a rectangular guide profile (19) open at both ends, where the other, closed, end of the bag shuts off one of the ends of the rectangular guide profile,—positioning the rectangular guide profile with the end not shut off by the bag in front of a shut off output (9) of the vacuum chamber and coupling the rectangular guide profile in a gas-tight manner to the output of the vacuum chamber,—opening the output of the vacuum chamber and guiding the box into the bag via the rectangular guide profile, and—folding the open end of the bag immediately followed by the sealing of the bag. By processing the box in the vacuum chamber before a plastic bag is put around the box, it is better to create underpressure in the box and flush it with nitrogen because the box has not yet been shut off on three sides by the plastic bag in a gas-tight manner. As a result, a better atmosphere can be created in the box or the optimal atmosphere in the box can be created in a faster manner.

10 Claims, 2 Drawing Sheets

(58) Field of Classification Search
CPC ..... B65B 31/025; B65B 31/04; B65B 35/30; B65B 220/16; B65D 81/2038
USPC ..... 53/403, 416, 432, 434, 510, 512, 449, 53/170
See application file for complete search history.

(56) References Cited

U.S. PATENT DOCUMENTS 5,062,252 A * 11/1991 Kupcikevicius ..... B65B 31/022 53/434
5,481,852 A * 1/1996 Mitchell ..... B65B 31/04 426/129
5,961,000 A * 10/1999 Sanfilippo ..... B65B 31/00 141/47
6,106,449 A * 8/2000 Wynne ..... B29C 44/1266 493/101
6,499,274 B1 * 12/2002 McDonald ..... B65B 31/022 198/465.1
6,539,689 B1 * 4/2003 Yoshimoto ..... B65B 31/022 53/434
8,047,128 B2 * 11/2011 Salvaro ..... F24C 15/00 99/352
8,707,660 B2 * 4/2014 Howes ..... B65B 9/20 53/450
2003/0046907 A1 * 3/2003 Costello ..... G01M 3/3281 53/512
2005/0028488 A1 * 2/2005 Higer ..... B65B 31/00 53/434
2005/0178090 A1 * 8/2005 Koke ..... B65B 31/024 53/434
2006/0064946 A1 * 3/2006 Evangelisti ..... B65B 31/024 53/510
2006/0207226 A1 * 9/2006 Levsen ..... B65B 31/046 53/512
2006/0266005 A1 * 11/2006 Koke ..... B65B 57/00 53/432
2006/0272291 A1 * 12/2006 Koke ..... B65B 31/024 53/432
2007/0020366 A1 * 1/2007 Luchansky ..... A23B 4/30 426/335
2007/0214752 A1 * 9/2007 Buchko ..... B65B 31/024 53/512
2008/0120944 A1 * 5/2008 Rimondi ..... B65B 31/043 53/285
2009/0260326 A1 * 10/2009 Grimm ..... B65B 61/005 53/434
2010/0062921 A1 * 3/2010 Veiseh ..... B65D 5/509 493/186
2010/0273622 A1 * 10/2010 Vonderhaar ..... B65B 1/02 493/267
2011/0167760 A1 * 7/2011 Spix ..... B65B 5/105 53/65
2011/0262603 A1 * 10/2011 Blattner ..... B65B 25/067 426/323
2012/0174531 A1 * 7/2012 Rothermel ..... B65B 31/024 53/432
2012/0297729 A1 * 11/2012 Scolaro ..... B65B 31/02 53/79
2013/0098785 A1 * 4/2013 Steffens ..... G01N 31/229 206/242
2014/0075889 A1 * 3/2014 Avrech ..... A23L 3/3418 53/432
2014/0123599 A1 * 5/2014 Gustafsson ..... B65B 31/021 53/405
2015/0175288 A1 * 6/2015 Alquati ..... B65B 49/16 53/450
2015/0210459 A1 * 7/2015 Balga ..... B65D 81/2069 206/213.1

* cited by examiner

METHOD AND APPARATUS FOR PACKAGING OF ONE OR MORE BOXES FILLED WITH TOBACCO IN A PLASTIC BAG

FIELD OF THE INVENTION

The invention relates to a method for packaging one or more tobacco-filled boxes in a plastic bag. The tobacco may be both treated and/or processed tobacco and green tobacco.

State of the Art

A method of this type is known from WO2014/042534A. According to this known method the box is first deposited in a bag open at one end and subsequently the air is evacuated from the bag (a customary method in this respect is placing the bag containing the box in a vacuum chamber) and flushing the contents of the bag with nitrogen. Thereafter, the hag is folded and sealed tight (if a vacuum chamber was used, the packed box is finally to be taken out of the vacuum chamber).

SUMMARY OF THE INVENTION

It is an object of the invention to improve the known method for packaging tobacco-filled boxes. To this end the invention is characterized by:

- placing the box in a vacuum chamber through an input,
- closing the vacuum chamber, then evacuating the vacuum chamber and thereafter creating an over-pressure nitrogen atmosphere in the vacuum chamber,
- putting a bag open at one end around a rectangular guide profile open at both ends, where the other, closed, end of the bag shuts off one of the ends of the rectangular guide profile,
- positioning the rectangular guide profile with the end not shut off by the bag in front of a shut off output of the vacuum chamber and coupling the rectangular guide profile in a gas-tight manner to the output of the vacuum chamber,
- opening the output of the vacuum chamber and guiding the box into the bag via the rectangular guide profile, and
- folding the open end of the bag immediately followed by the sealing of the bag.

Vacuum is to be understood in this context as under-pressure and not complete vacuum. This under-pressure may be such that there is mention of high vacuum or low vacuum and all gradations in between.

By processing the box in the vacuum chamber before a plastic bag is put around the box, under-pressure can be created in the box better and nitrogen flushing can be applied better because the box has not already been shut off on three sides by the plastic bag in a gas-tight manner. As a result, a better atmosphere in the box can be created or the optimal atmosphere in the box can be created in a faster manner than is the case with the known method.

An embodiment of the method according to the invention is characterized in that after the coupling of the rectangular guide profile to the output of the vacuum chamber an over-pressure nitrogen atmosphere is created in the rectangular guide profile. This prevents air from leaking into the rectangular guide profile in the event of a non fully air-tight coupling between the vacuum chamber and the rectangular guide profile.

A further embodiment of the method according to the invention is characterized in that before the nitrogen atmosphere is created, first the space in the rectangular guide profile is evacuated. During this operation the air present in the rectangular guide profile is removed, so that the oxygen present in it cannot have a detrimental effect on the conservation of the tobacco present in the box.

The rectangular guide profile can also be evacuated in an advantageous manner without subsequently feeding nitrogen under over-pressure to the rectangular guide profile.

Preferably, the length of the rectangular guide profile is smaller than that of the box and the bag when put around the rectangular guide profile is strapped around the rectangular guide profile. As a result, putting the bag around the box requires little space and the method can be executed in a relatively compact device.

Once the bag has been sealed to the rectangular guide profile, it is preferably moved to a position in which a following bag is put around the rectangular guide profile. This too provides that the method can be executed in a relatively compact device.

Once the box has been guided into the bag, preferably one or more further boxes are similarly guided into the same bag via the vacuum chamber before the bag is folded and sealed.

The invention likewise relates to a device for packaging one or more tobacco-filled boxes in a plastic bag, comprising:

- a vacuum chamber having an input and an output, and
- evacuation means for creating an under-pressure in the vacuum chamber,
- nitrogen supply means for creating an over-pressure nitrogen atmosphere in the vacuum chamber,
- transport means for transporting a box into and out of the vacuum chamber,
- folding means for folding the open end of a bag, and
- sealing means for sealing a bag.

With respect to the device the invention is characterized in that the device further includes:

- a rectangular guide profile open at both ends around which a bag open at one end can be put where the other, closed end of the bag shuts off one of the ends of the rectangular guide profile, as well as
- moving means for moving the rectangular guide profile between a first position in which a bag may be put around rectangular guide profile and a second position in which the rectangular guide profile with the end not shut off by the bag is present in front of the output of the vacuum chamber, and
- coupling means for coupling the rectangular guide profile to the output of the vacuum chamber in a gas-tight manner.

For the advantages of this device and of the two following embodiments reference be made to the advantages mentioned with respect to the method.

An embodiment of the device according to the invention is characterized in that the device comprises further evacuation means for creating an under-pressure in the rectangular guide profile.

A further embodiment of the device according to the invention is characterized in that the device comprises further nitrogen supply means for creating an over-pressure nitrogen atmosphere in the rectangular guide profile.

For realizing a compact device the length of the rectangular guide profile is preferably smaller than that of the box.

BRIEF DESCRIPTION OF THE DRAWINGS

The invention will now be described in more detail based on an example of embodiment of a device by which the method according to the invention may be executed while reference is made to the appended drawing figures, in which.

DETAILED DESCRIPTION OF THE DRAWINGS

Figure 1:
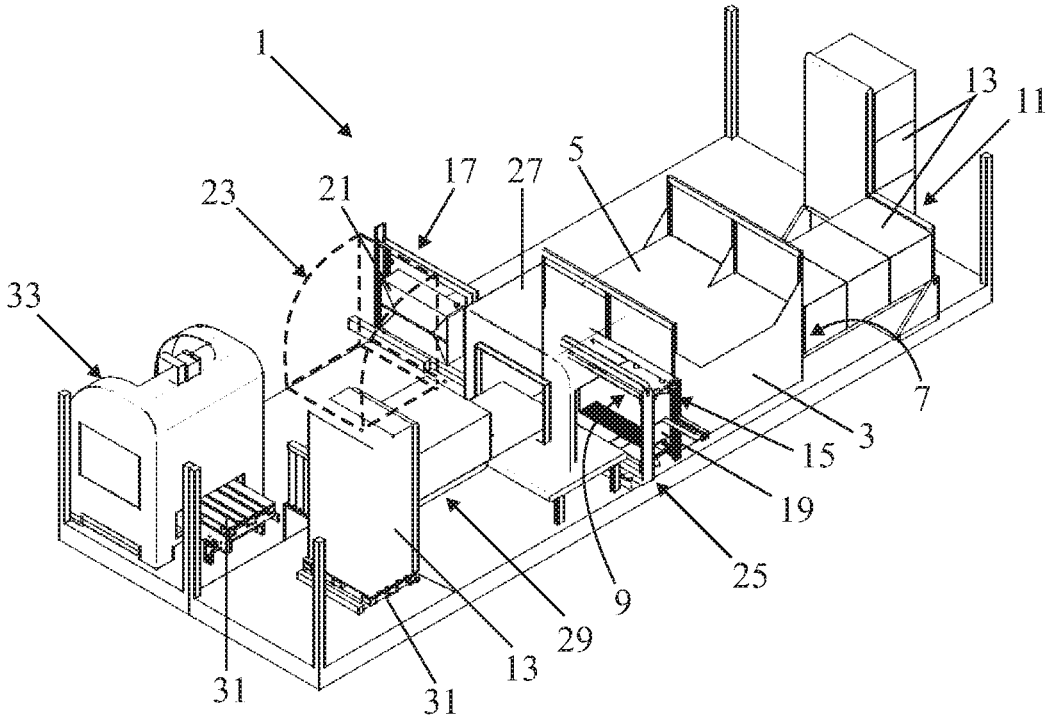
FIG. 1 shows a perspective view of an embodiment of the device according to the invention.
Figure 2:
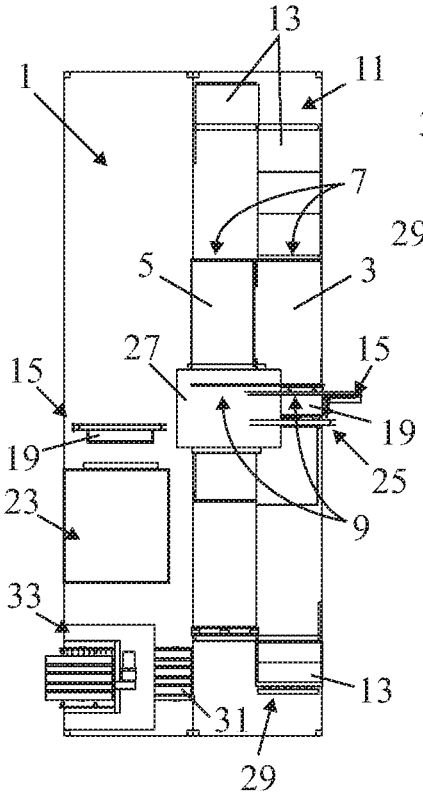
FIG. 2 shows a top view of the device shown in FIG. 1.
Figure 3:
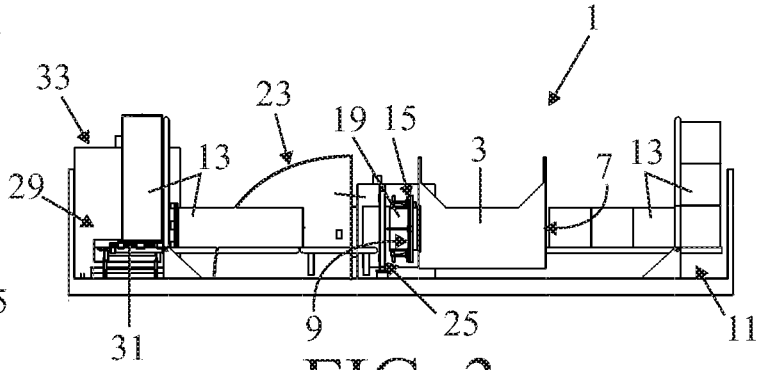
FIG. 3 shows a side view of the device shown in FIG. 1.
Figure 4:
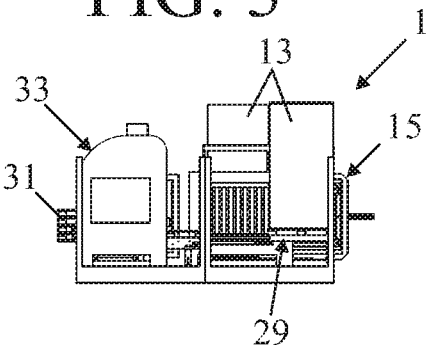
FIG. 4 shows a front view of the device shown in FIG. 1.

FIGS. 1 to 4 show an embodiment of the device according to the invention in a perspective view, top view, side view and front view respectively. The device 1 comprises two adjacent vacuum chambers 3 and 5 which each have an input 7 which can be shut off by means of a slide and an output 9 which can also be shut off by means of a slide. Located in front of the inputs of the vacuum chambers are tilting mechanisms 11 where stacks of three tobacco-filled boxes 13 are tilted and subsequently fed to the vacuum chambers. The boxes are transported through the vacuum chamber by transport means (conveyor belt). The vacuum chambers 3 and 5 are provided with evacuation means for creating an under-pressure in the vacuum chambers, as well as nitrogen supply means for creating an over-pressure nitrogen atmosphere in the vacuum chambers.

Two foil carriers 15 and 17 which are each provided with a short rectangular guide profile 19 open at both ends are movable along the outputs of the vacuum chambers. The foil carriers are movable between a first position (the position taken up by foil carrier 17) in which a plastic bag 21 is put around the rectangular guide profile, and a second position (the position taken up by foil carrier 15) in which the rectangular guide profile 19 is situated with the end not shut off by the bag in front of an output 9 of one of the vacuum chambers. The rectangular guide profiles can be moved in axial direction in the foil carrier, as is shown in the outermost positions of the rectangular guide profiles in the foil carriers 15 and 17 in FIG. 2. In the first position of the foil carrier 17 the rectangular guide profile 19 is moved to a foil supply device 23 and in the second position of the foil carrier 15 the rectangular guide profile 19 is moved to the output 9 of one of the vacuum chambers 3 and coupled to the vacuum chamber. Folding and sealing means 25 (cf. FIGS. 5, 7 and 8) for folding and sealing the open end of the bag can be moved along both outputs of the vacuum chambers as far as directly in front of the foil carriers.

The device 1 further includes further evacuation means for creating an under-pressure in the rectangular guide profile and further nitrogen supply means for creating an over-pressure nitrogen atmosphere in the rectangular guide profile. These further means are located in a removable chamber 27.

Once the bag has been folded and sealed, it is further transported to a further tilting device 29 where the stack of boxes 13 is placed upright on a pallet 31. This pallet is supplied by means of a pallet supply system 33.

Figure 5:
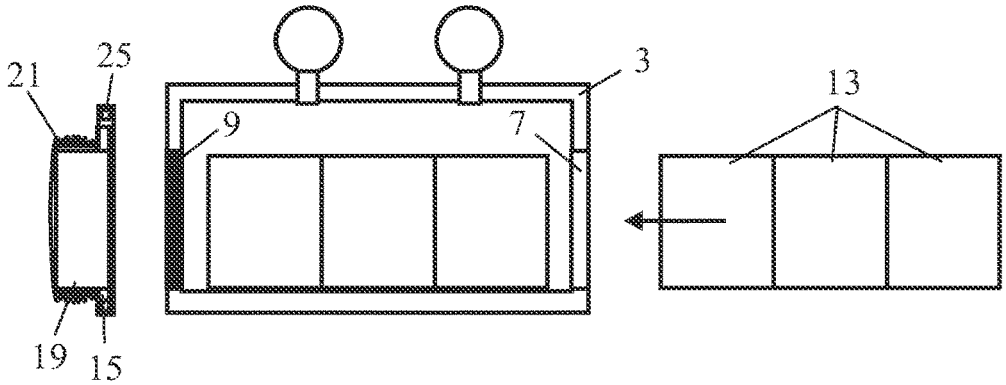
FIG. 5 shows a perspective view of the device shown in FIG. 1, seen from another side.
Figure 6:
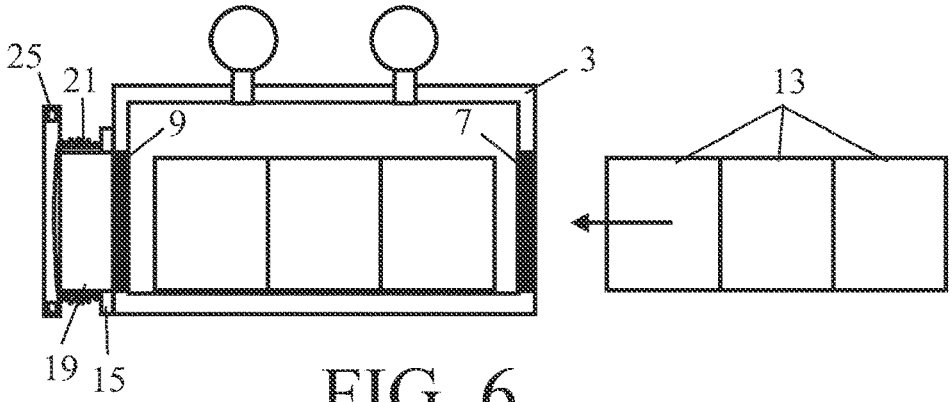
FIG. 6 shows a detail of the rectangular guide profile in the first position.

For illustrative purposes FIG. 5 shows the device 1 in a perspective view, but seen now from the other side having the rectangular guide profile 19 in the first position. This rectangular guide profile 19 is shown in detail in FIG. 6. The packaging process takes place as follows. Initially, three boxes 13 to be packaged are fed to one of the two vacuum chambers 3, 5 through the input 7. Under-pressure is created in the vacuum chamber as a result of which air is removed from the boxes. Subsequently, the vacuum chamber is filled with nitrogen until the gas pressure in the vacuum chamber exceeds the pressure in the environment. As a result, the contents of the boxes are flushed with nitrogen.

At the same time a piece of tubular foil is put around the rectangular guide profile 19 open at both ends and cut off from the roller from which it has been wound off. The cut-off end is then sealed. This is affected by the movable folding and sealing means 25. The foil carrier 17 accommodating the rectangular guide profile is then moved in front of the output 9 of the vacuum chamber, (cf. FIG. 7) where the rectangular guide profile 19 is moved in axial direction until it reaches the vacuum chamber and is connected to the vacuum chamber in a gas-tight manner. The space in the rectangular guide profile is then also filled with nitrogen until an over-pressure atmosphere of nitrogen is found there as well.

Figure 7:
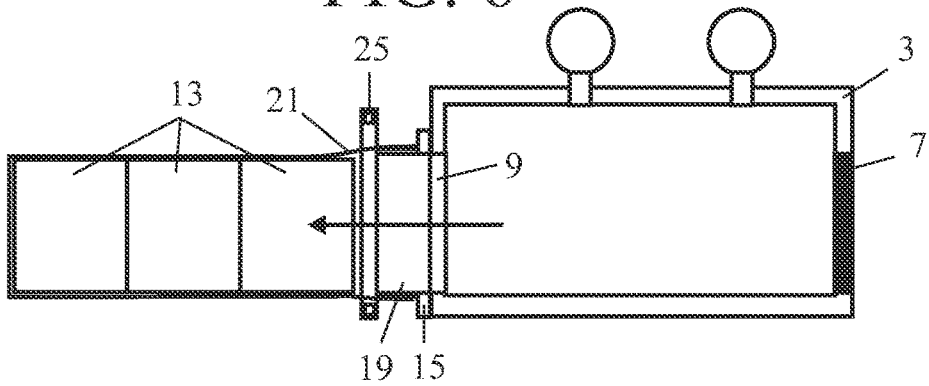
FIG. 7 shows a perspective view of the device having the rectangular guide profile in second position in front of the output of one of the vacuum chambers.
Figure 8:
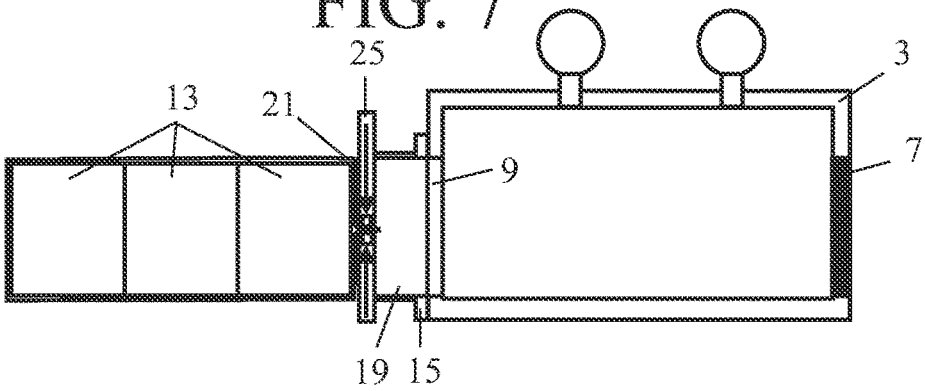
FIG. 8 shows a perspective view of the device having the rectangular guide profile in second position in front of the output of the other vacuum chamber

Subsequently, the output 9 of the vacuum chamber 3 is opened and the boxes are shifted into the bag through the rectangular guide profile 19. The open end of the bag is then folded and sealed. This is again affected by the movable folding and sealing means 25. Then the boxes 13 packed in the bag are stacked upright on a pallet 31 and discharged of. At the same time on a second foil carrier 15 a bag 21 (cf. FIG. 1) is put around the rectangular guide profile and in a second vacuum chamber a second set of three boxes is processed, which may lead to the realization of a high processing rate. By way of illustration FIGS. 7 and 8 show in a perspective view the device 1 having the rectangular guide profile 19 in the second position in front of the output 9 of one of the vacuum chambers 5, respectively in the second position in front of the output of the other vacuum chamber 3.

Albeit the invention has been described in the foregoing with reference to the drawings, it should be observed that the invention is not by any manner or means restricted to the embodiment shown in the drawings. The invention also extends to all embodiments deviating from the embodiment shown in the drawings within the scope defined by the claims.

The invention claimed is:

1. Method for packaging one or more tobacco-filled boxes in a plastic bag, comprising:

placing the box in a vacuum chamber through an input, closing the vacuum chamber, then evacuating the vacuum chamber and thereafter creating an over-pressure nitrogen atmosphere in the vacuum chamber, putting a bag open at one end around a rectangular guide profile open at both ends, where the other, closed, end of the bag shuts off one of the ends of the rectangular guide profile, positioning the rectangular guide profile with the end not shut off by the bag in front of a shut off output of the vacuum chamber and coupling the rectangular guide profile in a gas-tight manner to the output of the vacuum chamber, opening the output of the vacuum chamber and guiding the box into the bag via the rectangular guide profile, sealing the open end of the bag.

2. Method as claimed in claim 1, wherein after the coupling of the rectangular guide profile to the output of the vacuum chamber an over-pressure nitrogen atmosphere is created in the rectangular guide profile.

3. Method as claimed in claim 2, wherein before the nitrogen atmosphere is created, first the space in the rectangular guide profile is evacuated.

4. Method as claimed in claim 1, wherein once the rectangular guide profile has been coupled to the output of the vacuum chamber the space in the rectangular guide profile is evacuated.

5. Method as claimed in claim 1, wherein once the bag has been sealed to the rectangular guide profile it is moved to a position in which a following bag is put around the rectangular guide profile.

6. Method as claimed in claim 1, wherein once the box has been guided into the bag, a following box is similarly guided into the bag via the vacuum chamber before the open end of the bag is sealed.

7. Device for packaging one or more tobacco-filled boxes in a plastic bag, comprising:

a vacuum chamber having an input and an output, evacuation means for creating an under-pressure in the vacuum chamber, nitrogen supply means for creating an over-pressure nitrogen atmosphere in the vacuum chamber, transport means for transporting a box into and out of the vacuum chamber, and sealing means for sealing an open end of a bag, wherein the device further includes a rectangular guide profile open at both ends around which a bag open at one end can be put, where the other, closed end of the bag shuts off one of the ends of the rectangular guide profile, as well as moving means for moving the rectangular guide profile between a first position in which a bag may be put around the rectangular guide profile and a second position in which the rectangular guide profile with the end not shut off by the bag is present in front of the output of the vacuum chamber, and coupling means for coupling the rectangular guide profile to the output of the vacuum chamber in a gas-tight manner.

8. Device as claimed in claim 7, wherein the device comprises further evacuation means for creating an under-pressure in the rectangular guide profile.

9. Device as claimed in claim 7, wherein the device comprises further nitrogen supply means for creating an over-pressure nitrogen atmosphere in the rectangular guide profile.

10. Device as claimed in claim 7, wherein the length of the rectangular guide profile is smaller than that of the box.

* * * * *